US005950869A

United States Patent [19]

Wegman

[11] Patent Number: 5,950,869

[45] Date of Patent: Sep. 14, 1999

[54] PIVOTING NOZZLE FOR POWDER FILLING SYSTEMS

[75] Inventor: Paul M. Wegman, Pittsford, N.Y.

[73] Assignee: Xerox Corporation, Stamford, Conn.

[21] Appl. No.: 09/130,228

[22] Filed: Aug. 6, 1998

[51] Int. Cl.[6] ..... B67B 7/00

[52] U.S. Cl. ..... 222/1; 222/232; 222/239; 222/527; 222/529; 141/256; 141/284; 141/337

[58] Field of Search ..... 222/1, 232, 239, 222/240, 241, 242, 410, 411, 412, 413, 527, 529, 142.9, 553, 562; 141/2, 18, 67, 256, 90, 129, 284, 333, 337, 144, 346; 355/260, 246, 245, 15, 3 DD; 118/652; 251/208, 212

[56] References Cited

U.S. PATENT DOCUMENTS

| | | | |
|---|---|---|---|
| 2,973,124 | 4/1961 | Reese . | |
| 3,006,512 | 7/1961 | Keathley, Sr. et al. | 222/553 |
| 4,130,147 | 12/1978 | Langlie et al. | 141/98 |
| 4,561,759 | 12/1985 | Knott | 355/3 DD |
| 4,650,312 | 3/1987 | Vineski | 355/15 |
| 4,706,719 | 11/1987 | Eversdijk | 141/337 |
| 4,756,647 | 7/1988 | Fassbinder | 251/208 |
| 4,932,355 | 6/1990 | Neufeld | 118/652 |
| 4,977,428 | 12/1990 | Sakakura et al. | 355/245 |
| 5,095,338 | 3/1992 | Hayes, Jr. et al. | 355/246 |
| 5,308,040 | 5/1994 | Torres | 251/208 |
| 5,337,794 | 8/1994 | Nishiyama et al. | 141/144 |
| 5,438,396 | 8/1995 | Mawdesley | 355/260 |
| 5,531,253 | 7/1996 | Nishiyama et al. | 141/90 |
| 5,685,348 | 11/1997 | Wegman et al. | 141/2 |
| 5,685,351 | 11/1997 | Kazarian et al. | 141/325 |

*Primary Examiner*—Henry J. Recla
*Assistant Examiner*—Khoa D. Huynh
*Attorney, Agent, or Firm*—John S. Wagley

[57] ABSTRACT

An apparatus for assisting in filling a container from a hopper containing a supply of powder is provided. The apparatus includes a conduit flexibly connected to the hopper and extending downwardly therefrom. The conduit is adapted to permit a flow of powder therewithin. The conduit defines a longitudinal axis thereof and the hopper defines a longitudinal axis thereof. The conduit is flexibly connected to the hopper so that the hopper and the conduit may be arranged in a first position with the longitudinal axis of the hopper and the longitudinal axis of said conduit being coincident and may be arranged in a second position with the longitudinal axis of the hopper and the longitudinal axis of the conduit being skewed with respect to each other.

19 Claims, 8 Drawing Sheets

PIVOTING NOZZLE FOR POWDER FILLING SYSTEMS

This invention relates generally to filling a container with material, and more particularly concerns a fill nozzle for controlling the flow of powders such as toner from a fill tube to a toner container.

Cross reference is made to the following application filed concurrently herewith: Attorney Docket Number D/98388 entitled "Eccentric Nozzle for Powder Filling Systems" by Paul M. Wegman.

Currently when filling powders, for example toners into toner containers, toner is transported from the toner supply hopper into the container by a rotating auger. The auger is a spiral shaped mechanical part which pushes particles of toner inside a fill tube by direct mechanical contact. The nature of this mechanical contact process creates substantial limitations on accuracy and productivity of the toner filling operation. The speed of the toner movement in the fill tube is proportional to the speed of rotation of the auger and is limited by heat release due to auger/toner friction. High auger speed will cause the toner to melt, particularly for low melt toner such as disclosed in U.S. Pat. No. 5,227,460 to Mahabadi et al. the relevant portions thereof incorporated herein by reference.

The filling process requires the auger to rotate within a fixedly positioned fill tube. The auger is thus rotatably mounted to an auger support while the fill tube is fixedly supported to a fill tube support. To avoid excessive wear and more particularly the generation of heat within the fill tube and upon the auger, clearance is preferably provided between the auger and the fill tube to prevent the generation of heat from friction. To optimize the flow of powder through the fill tube, the auger is preferably as close to the sides of the fill tube as possible. The alignment, therefore, of the auger to the fill tube is critical.

Further, particularly when filling small containers and containers with a small opening, the size of the fill tube may be quite small. The auger fitting within the fill tube is thus also quite small. This is particularly exacerbated when, in production lines, the hopper may be required to be quite large, thus generating a very long slender fill tube.

During installations of a fill line, the auger is adjusted by an auger drive adjustment and the fill tube is positioned by an adjustment in the hopper. The alignment of the auger within the fill tube is thus difficult, time consuming and imprecise.

Furthermore, the large slender auger may either be bent or not straight as well as it may deflect under load. The auger thus may need to be straightened so that it does not contact the walls of the fill tube. The straightening of the auger may be more a matter of luck than skill or technique and thus may represent a large period of time to properly align the auger to the fill tube.

High production filling lines are typically used for toner containers and for process cartridges or housings which include a supply of toner as well as various xerographic components which wear or have a life significantly less than that of the printing machine or copier. The cartridges or containers filled with these filling lines are advanced by means of an indexing conveyor. The containers are indexed into a position under the hopper. A nozzle is positioned at the end of the fill tube and is, hopefully, in alignment with an opening in the container or cartridge.

The alignment of the nozzle to the opening in the cartridge or container represents a significant problem. The hopper may be adjusted by a manual hopper adjustment and the positioning of the cartridge may be adjusted by index adjustments to the conveyor or by repositioning of the pallets or pucks which cradle the containers or cartridges on the conveyor.

The adjustment of the fill tube with respect to the container may be quite difficult. In particular, the fill tube may be required to be aligned with the auger permitting no further adjustment of the fill tube. Thus, the indexing conveyor must be adjusted. Such an adjustment is difficult, time consuming and imprecise.

The following disclosures may be relevant to various aspects of the present invention:

U.S. Pat. No. 5,337,794
Patentee: Nishiyama et al.
Issue Date: Aug. 16, 1994

U.S. Pat. No. 5,438,396
Patentee: Mawdesley
Issue Date: Aug. 1, 1995

U.S. Pat. No. 5,095,338
Patentee: Hayes, Jr. et al.
Issue Date: Mar. 10, 1992

U.S. Pat. No. 4,977,428
Patentee: Sakakura et al.
Issue Date: Dec. 11, 1990

U.S. Pat. No. 4,932,355
Patentee: Neufeld
Issue Date: Jun. 12, 1990

U.S. Pat. No. 4,650,312
Patentee: Vineski
Issue Date: Mar. 17, 1987

U.S. Pat. No. 4,561,759
Patentee: Knott
Issue Date: Dec. 31, 1985

U.S. Pat. No. 5,531,253
Patentee: Nishiyama et al.
Issue Date: Jul. 2, 1996

U.S. Pat. No. 5,685,348
Patentee: Wegman et al
Issue Date: Nov. 11, 1997

U.S. patent application Ser. No. 08/540,993
Applicant: Wegman et al
Filing Date: Oct. 12, 1995

U.S. patent application Ser. No. 08/829,925
Applicant: Wegman et al
Filing Date: Apr. 1, 1997

U.S. patent application Ser. No. 08/823,034
Applicant: Wegman et al
Filing Date: Apr. 1, 1997

U.S. patent application Ser. No. 08/923,016
Applicant: Zelazny et al
Filing Date: Sep. 3, 1997

The relevant portions of the foregoing disclosures may be briefly summarized as follows:

U.S. Pat. No. 5,337,794 describes a powder filling apparatus and a method for filling a container with powder. The toner container is filled by conveying toner from a supply hopper through a nozzle with a valve on the end. The valve is disposed at the bottom opening of the nozzle to release and close the opening of the nozzle by the vertical movement of the valve element.

U.S. Pat. No. 5,438,396 is drawn to a toner anti-dribble device which is attached to a toner container having a vertical fill tube and a rotatable auger for feeding toner into a toner container. The toner anti-dribble device also has a sleeve member engagable with the fill tube. A plurality of flexible insertion wires are inserted through the sleeve member into the toner container and disposed substantially perpendicular to the insertion direction of the toner. The arrangement of the wires positively prevents toner dribble between fills while being flexible enough to flex in proportion to the fill rate, which prevents fusing of the toner on the wires.

U.S. Pat. No. 5,095,338 teaches a developer which discharges used carrier particles using a magnetic valve. Discharge of developer material from the developer housing is controlled by a permanent magnet and an electromagnet positioned adjacent an exit port in the developer housing. The permanent magnet generates a magnetic flux field in the region of the exit port to form a developer material curtain which prevents the passage of developer material from the exit port. When the electromagnet is energized, it generates a magnetic flux field which attracts developer material from the developer material curtain. Upon de-energization of the electromagnet, the developer material attracted to it is discharged.

U.S. Pat. No. 4,977,428 discloses an electrographic printer having a pulse motor for driving a conveyor. The conveyor is built into the developer unit. The conveyor is controlled during the initialization process of the apparatus by setting the rotational speed of the motor at a lower level upon startup of the motor. The lower speed results in higher torque to overcome solidification of the toner.

U.S. Pat. No. 4,932,355 discloses a method for removing a developer mix from a developing station with a magnetic closing device which is in the vicinity of a discharge opening in the developing station. In its energized condition, the magnetic closing device creates a magnetic field which acts on the developer mix to form a plug of developer mix in the region of the discharge opening. In the de-energized condition, the magnetic closing device releases the plug of developer mix.

U.S. Pat. No. 4,650,312 discloses a structure for minimizing bridging or packing of toner in the flights of an auger of a toner removal and collection system. The toner anti-bridging structure includes a pendulum which is caused to periodically bang in to the auger to create vibrations in the auger structure.

U.S. Pat. No. 4,561,759 discloses a device for filling and filtering toner from a supply container. A filter basket is disposed in the region of the filling opening which is closed from the feed container by a filter mesh and an electric vibrator connected thereto by a linkage which can be automatically triggered at the beginning of a filling operation.

U.S. Pat. No. 5,531,253 discloses a cleaner for cleaning the nozzle portion of a powder filling apparatus by equally evacuating the inside and the outside of the container and dropping powder through the nozzle portion into the container simultaneously with the raising the pressure outside the container.

U.S. Pat. No. 5,685,348 teaches a method and apparatus for filling a container with toner using a series of traveling magnetic fields to control the flow of toner from a supply of toner to the container. Initially, an empty container is placed under a fill tube through which the toner will be supplied to the container. In the filling process the traveling magnetic fields, which are supplied by turning on and off a series of solenoids, and gravity cause toner from the toner supply to move through the fill tube. When a solenoid is turned on toner particles are attracted to its magnetic field where a plug of toner is formed. The solenoids are controlled so that a discrete amount of toner is supplied in each on/off cycle of the solenoids. The solenoid on/off cycle is repeated until the container is filled with toner. When the container is filled, the appropriate solenoid is activated so that a plug of toner stops the flow of toner in the fill tube. The filled container is removed from the fill tube and an empty container is put in its place so that the solenoid on/off cycle may begin again.

U.S. patent application Ser. No. 08/540,993 filed Oct. 12, 1995, entitled "Electromagnetic Valve and Demagnetizing Circuit", by Wegman et al., which is assigned to the same assignee as this application, teaches a method and apparatus for filling a container with a magnetic material using an electromagnetic valve and a demagnetizing circuit to control the flow and properties of the material. In the filling process an auger located inside of the fill tube rotates and moves the material through the fill tube. When the container is filled, the auger stops rotating and the electromagnetic valve is actuated. The electromagnetic valve supplies a magnetic field which holds the material in place, plugging the fill tube with the material as the container is removed and a new container is placed to be filled. When the electromagnetic valve is switched off, a demagnetizing circuit is activated. After the material is demagnetized the auger is switched on and the material flows again to fill the container.

U.S. patent application Ser. No. 08/829,925 filed Apr. 1, 1997, entitled "Oscillating Valve for Powders", Wegman et al., which is assigned to the same assignee as this application, teaches a method for filling a powder container. The method includes the steps of placing a first powder container to be filled in filling relationship to a discharge feature in the vessel, directing the powder in the vessel toward a member located at least partially within the vessel, the member defining a restriction therein such that the powder clogs within the restriction, mechanically exciting the powder at least adjacent the restriction to improve the flow properties of the powder so as to unclog the powder within the restriction, dispensing powder through the restriction, through the discharge feature and into the first container, stopping the mechanical excitation of the powder so as to clog the restriction with the powder, removing the first container from the vessel, and placing a second container to be filled in filling relationship to the vessel.

U.S. patent application Ser. No. 08/823,034 filed Apr. 1, 1997, entitled "Vibratory Filler for Powders", Wegman et al., which is assigned to the same assignee as this application, teaches a method for filling a powder container. The method includes the steps of placing a first powder container to be filled in filling relationship to a supply of powder in a vessel, mechanically exciting the powder in the vessel to improve its flow properties, dispensing powder from the vessel into the first container, removing the first container from the vessel, and placing a second container to be filled in filling relationship to the vessel.

U.S. patent application Ser. No. 08/923,016, filed Sep. 3, 1997, by Zelazny et al which is assigned to the same assignee as this application discloses an apparatus for assisting in filling a container from a hopper containing a supply of powder. The apparatus includes a conduit operably connected to the hopper and extending downwardly therefrom. The conduit is adapted to permit a flow of powder therewithin. The apparatus also includes a nozzle operably connected to the conduit and extending downwardly therefrom. The nozzle defines an inlet thereof for receiving powder from the conduit and defines an outlet thereof for dispensing powder from the nozzle to the container. The inlet defines an inlet cross sectional area perpendicular to the flow the powder and the outlet defines an outlet cross sectional area perpendicular to the flow the powder. The inlet cross sectional area is larger than the outlet cross sectional area. The apparatus further includes a conveyor located at least partially within the conduit. The conveyor assists in providing the flow of powder from the container. The dimensions of the nozzle are selected so as to provide a ratio of the inlet cross sectional area to the outlet cross sectional area such that the flow of powder does not seize as it progresses through the nozzle.

All of the above references are hereby incorporated by reference.

SUMMARY OF THE INVENTION

In accordance with one aspect of the present invention, there is provided an apparatus for assisting in filling a container from a hopper containing a supply of powder. The apparatus includes a conduit flexibly connected to the hopper and extending downwardly therefrom. The conduit is adapted to permit a flow of powder therewithin. The conduit defines a longitudinal axis thereof and the hopper defines a longitudinal axis thereof. The conduit is flexibly connected to the hopper so that the hopper and the conduit may be arranged in a first position with the longitudinal axis of the hopper and the longitudinal axis of said conduit being coincident and may be arranged in a second position with the longitudinal axis of the hopper and the longitudinal axis of the conduit being skewed with respect to each other.

Pursuant to another aspect of the present invention, there is provided a method for filling a powder container with a supply of powder in a hopper. The method includes the steps of positioning a conduit in a powder receiving relationship below the supply of powder in a hopper, inserting an auger at least partially within the conduit for assisting in the flow of the supply of powder through the conduit, and repositioning the conduit with respect to the auger by pivoting at least one of the conduit and the hopper with respect to each other.

Pursuant to yet another aspect of the present invention, there is provided a method for filling a powder container with a supply of powder in a hopper. The method includes the steps of positioning a conduit in a powder receiving relationship below the supply of powder in a hopper, placing a first powder container to be filled in filling relationship to the conduit, repositioning the conduit with respect to the first powder container by pivoting at least one of the conduit and the hopper with respect to each other, dispensing powder through the conduit, through the nozzle feature and into the first container, removing the first container from the hopper, and placing a second container to be filled in filling relationship to the hopper.

Other features of the present invention will become apparent as the following description proceeds and upon reference to the drawings, in which.

DETAILED DESCRIPTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 2:
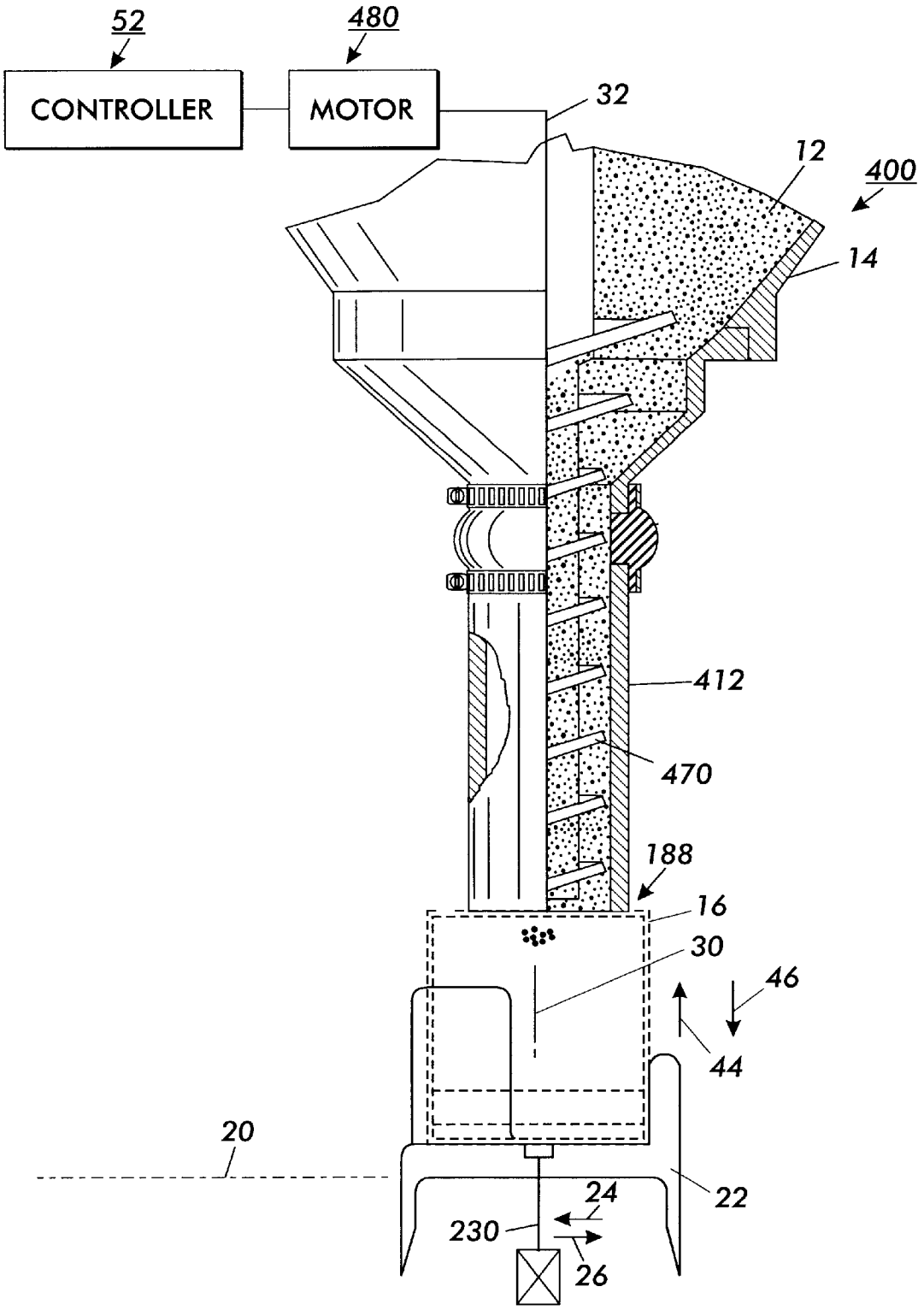
FIG. 2 is an elevational view of a container filling system with the auger and flexible conduit arrangement partially in section utilizing the nozzle of FIG. 1 showing the toner container being raised to the fill position in the filling system at the filling position.

According to the present invention and referring first to FIG. 2, powder filling assisting apparatus 400 is shown. The powder filling assisting apparatus 400 is used to convey powder 12 in the form of toner for use in a copier or printer from a hopper 14 to a container 16. The powder filling apparatus 400 is mounted to filling line 20 preferably to permit for the filling of large production quantities of containers 16. Each of the containers 16 are preferably mounted to a carrying device 22. The device 22 is movable in the direction of either arrow 24 or 26. The carrying device 22 serves to position container opening centerline 30 in alignment with apparatus centerline 32.

The powder filling assisting apparatus 400 includes a conduit 412 which is used to direct the powder 12 into the container 16. The conduit 412 is connected to the hopper 14 and is preferably in the form of a hollow tube or funnel.

Figure 3:
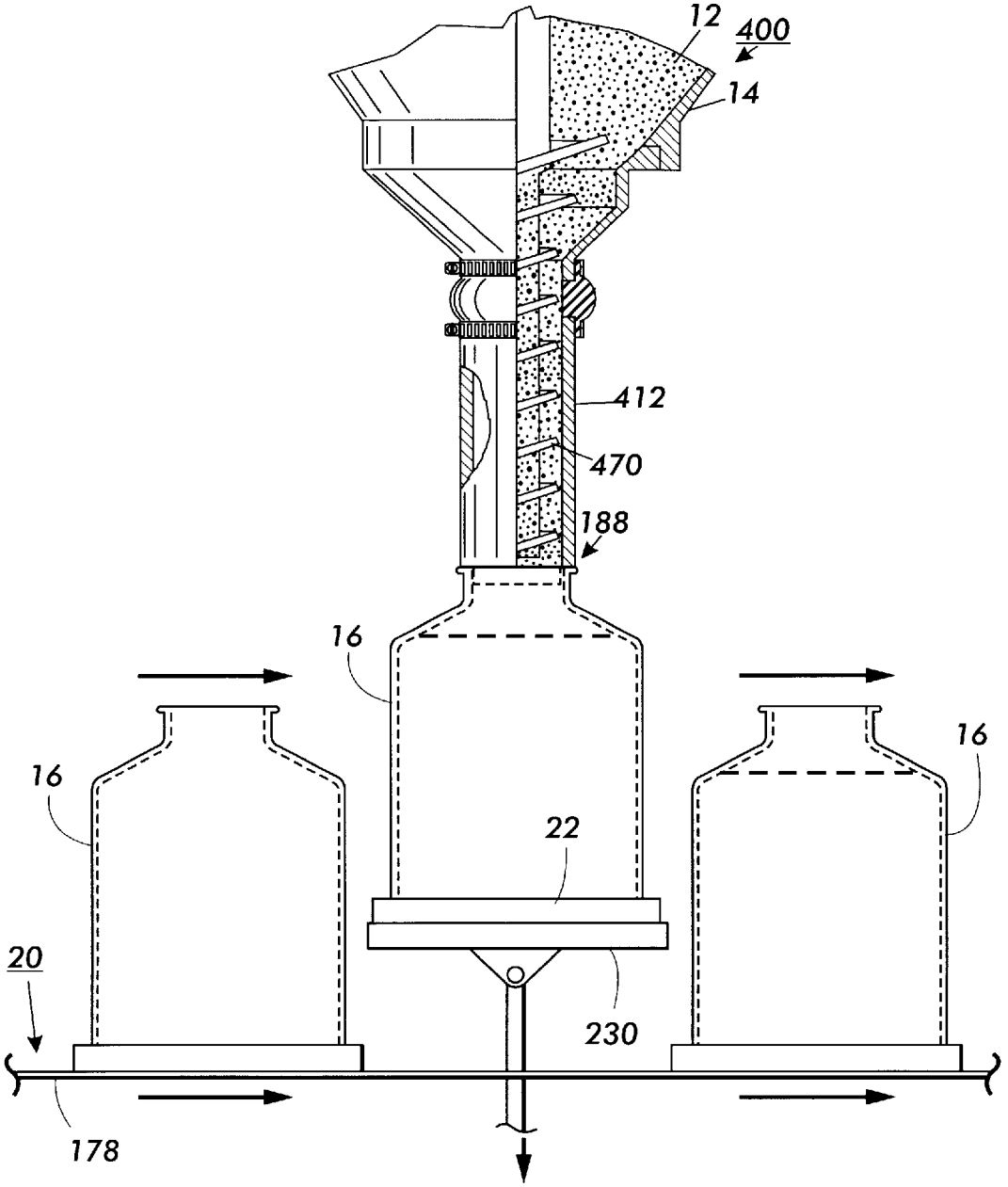
FIG. 3 is an elevational view of a container filling system with the auger and flexible conduit arrangement partially in section for use with the high speed nozzle for developer material of FIG. 1 after the container is filled.

Referring now to FIG. 3, the hopper 14 is positioned above the container 16 whereby gravity will assist in the flow of powder 12 toward the container 16. To optimize the flow of powder 12 toward the container 16, the powder filling apparatus 400 further includes a conveyor 470 positioned at least partially within the conduit 412 for assisting in the flow of the powder 12. The conveyor 470 is preferably in the form of a spiral conveyor or auger. For example, the auger 470 may be in the form of a spiral shaped auger.

Referring again to FIG. 2, preferably, the conduit 412 may be insertable into opening 188 of the container 16. The insertion of the conduit 412 in the opening 188 may be accomplished in any suitable method. For example, the carrying device 22 and, consequently, the container 16 may be movable upward in the direction of arrow 44 for engagement with the conduit 412 and downward in the direction of arrow 46 for disengagement from the opening 188. The upward and downward motion of the device 22 and the container 16 permits the container 16 to be indexed in the direction of arrows 24 and 26.

To permit the filling of a number of containers 16, the flow of powder 12 from the hopper 14 must be halted during the indexing of a filled container 16 from the fill position and during the indexing of the unfilled container 16 toward the filling position.

As shown in FIG. 2, the flow of powder 12 may be halted by the stopping of auger 470 within the conduit 412. The auger 470 may be rotated by any suitable method, i.e. by motor 480 operably connected to the auger 470. The motor 480 is connected to a controller 52 which sends a signal to the motor 480 to stop the rotation of the auger 470 during indexing of the carrying device 22. It should be appreciated, however, that the flow of powder 12 through the conduit 412 may be further controlled by the use of a valve (not shown).

FIG. 2 shows the powder filling assisting apparatus 400 in the container up position to enable filling of the container 16. The conduit 412 is positioned in the opening 188 of the container 16.

Figure 4:
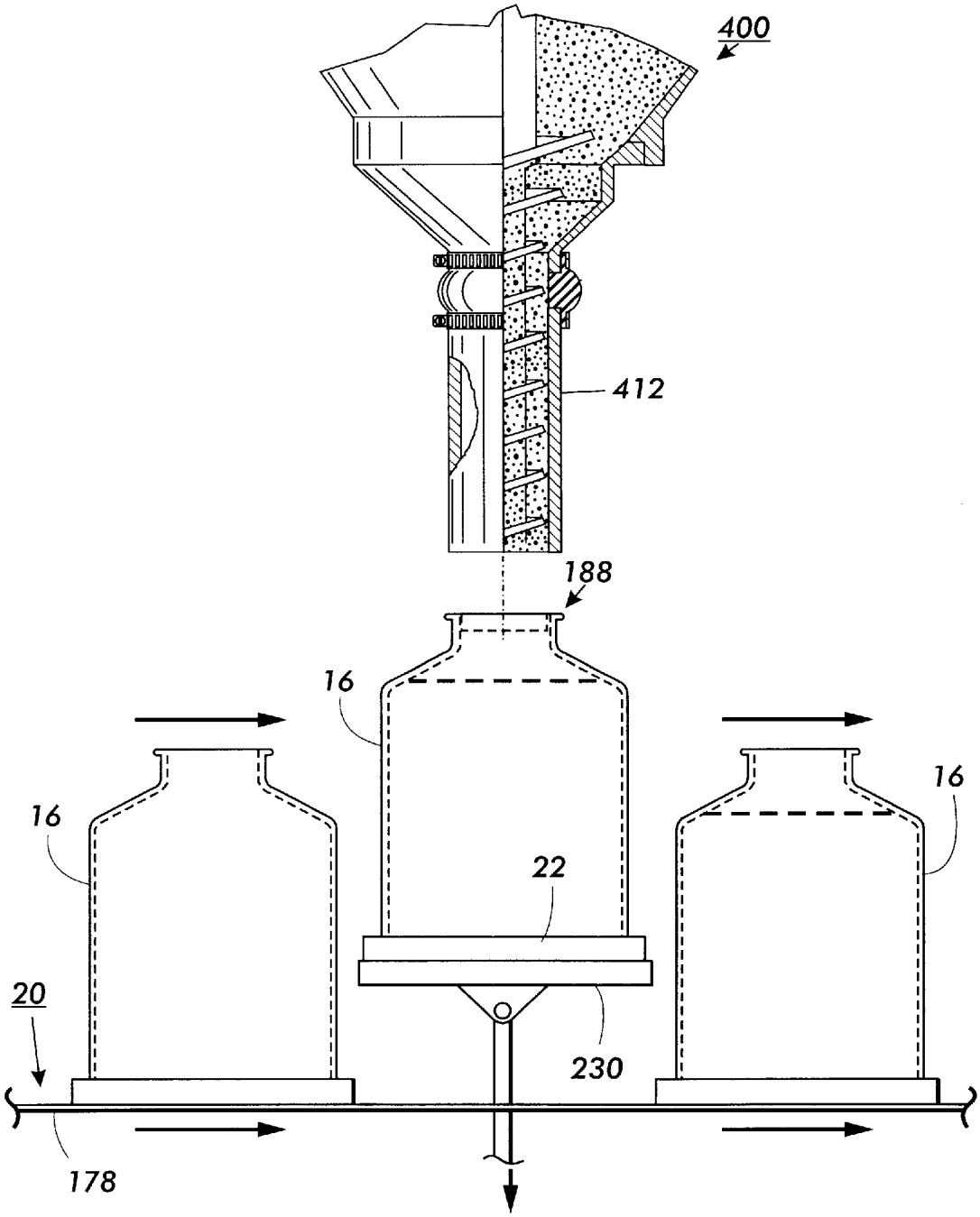
FIG. 4 is an elevational view of the container filling system for use with the auger and flexible conduit arrangement for developer material of FIG. 1 prior to filling the container.

A Referring now to FIG. 4, the powder filling assisting apparatus 400 is shown with in the container down position to enable indexing of the carrying device 22. The carrying device 22 indexes the filled container out of the fill position and indexes the unfilled container into the fill position. The conduit 412 is removed from the opening 188 of the container 16 in this position.

Figure 1:
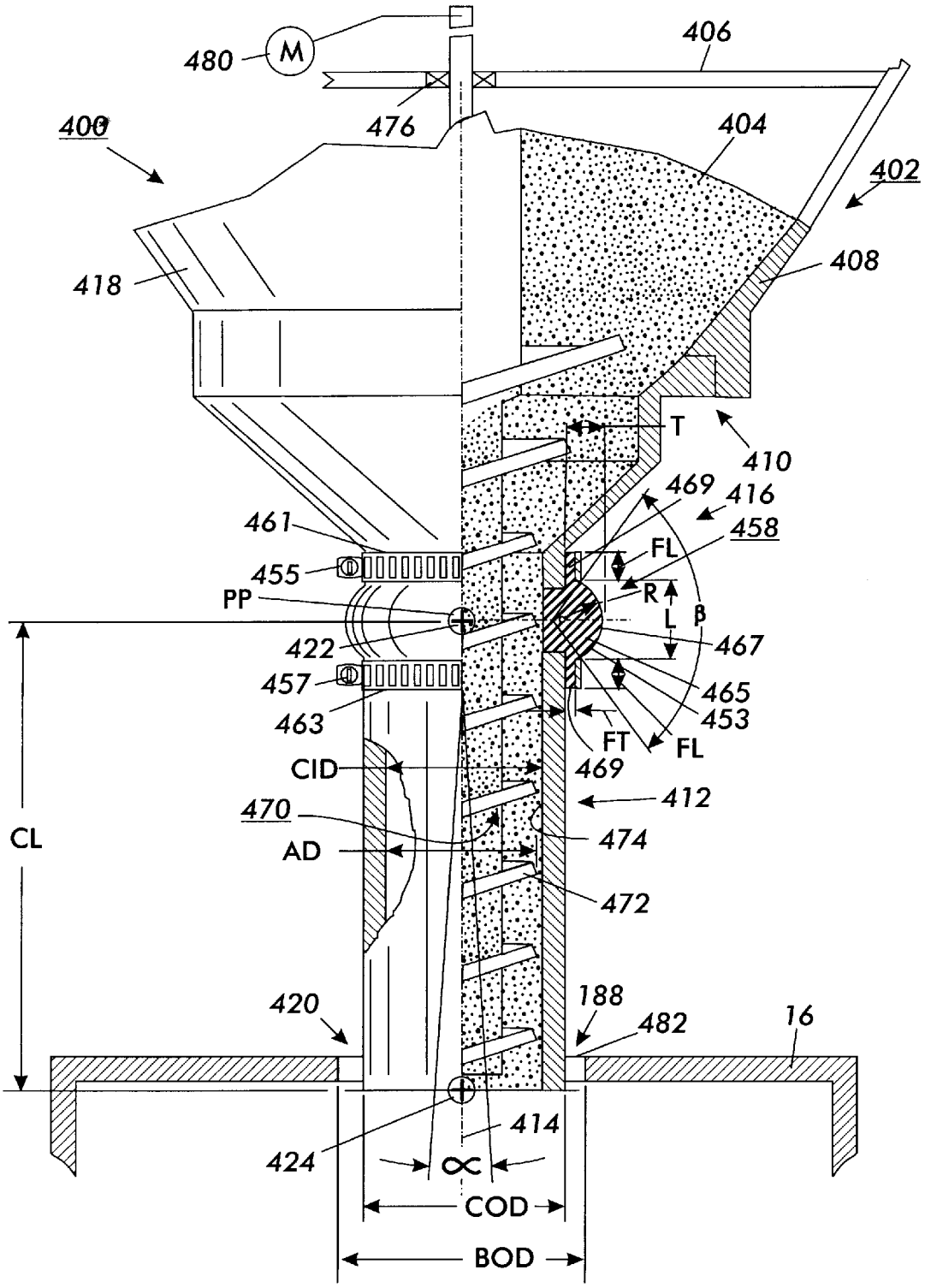
FIG. 1 is a partial cross-sectional schematic view of an auger and flexible conduit arrangement for developer material according to the present invention.

According to the present invention, and referring now to FIG. 1, the apparatus 400 for assisting in filling a container from a hopper containing a supply of powder is shown in greater detail. The apparatus 400 is mounted to, for example, hopper 402, restoring a supply of powder 404. The hopper 402 includes a hopper frame 406. The hopper frame 406 may be made of any suitable durable material that is not chemically reactive with the powder 404, for example stainless steel, and may either be mounted to other portions of the filling line or separately mounted to the production floor. The hopper 402 may have any suitable shape but preferably includes an inverted conical or funnel shape portion 408 which defines a lower opening 410 therein for permitting the passage of supply of powder 404 therefrom. The hopper 402 defines hopper longitudinal axis 418 thereof.

The hopper 402 may have any suitable size capable of containing a sufficient supply of powder 404. The hopper 402 may be made of any suitable durable material that is not chemically reactive to the powder 404 and may, for example, be made of a stainless steel.

The apparatus 400 includes conduit 412 which is pivotably connected to the hopper 402. The conduit 412 extends downwardly from the hopper 402. The conduit 412 is adapted to permit a flow of the powder 404 therethrough. The conduit 412 defines conduit longitudinal axis 414 thereof.

The conduit 412 defines a conduit inlet 416 of the conduit 412. The conduit inlet 416 is utilized to receive the supply of powder 404 from the hopper 402. The conduit 412 further defines a conduit outlet 420 for dispelling the powder 404 from the conduit 412. The conduit inlet 416 has an inlet center 422 positioned centrally within the conduit inlet 416. The conduit outlet 420 has a conduit outlet center 424 of the conduit outlet 420 which is positioned centrally within the conduit outlet 420.

The conduit 412 is positioned and mounted with respect to the hopper 402 so that the conduit longitudinal axis 414 of the conduit 412 may be pivotably positioned with respect to the longitudinal axis 418 of the hopper 402 so that as the conduit 412 pivots with respect to the hopper 402, the conduit longitudinal axis 414 of the conduit 412 with respect to the longitudinal axis 418 of the hopper 402 may be altered.

The conduit 412 may be made of any suitable durable material that is not chemically reactive with the powder 404. For example, the conduit 412 may be made of a metal or a plastic. Preferably the conduit 412 is made of stainless steel.

Preferably, to assist in the flow of powder 404 through the conduit 412, the apparatus 400 further includes conveyor 470 in the form of a helical auger. The auger 470 includes a cylindrical outer periphery 472 which is matingly fitted to an inner periphery 474 of the conduit 412.

Preferably, the auger 470 is rotatably secured to hopper frame 406 by bearings 476. The auger 470 may be propelled by any suitable means, for example, by motor 480 connected to the auger 470. The outer periphery 472 of the auger 470 is concentric with the longitudinal axis 418 of the hopper 402 and the auger 470 is mounted onto bearings 476 such that the conveyor 470 rotates about the longitudinal axis 418 of the hopper 402 as well.

Since the auger 470 rotates about the conduit 412, it is important that the auger 470 is in proper alignment with the conduit 412 such that the outer periphery 472 of the auger 470 does not rub or bind against inner periphery 474 of the conduit 412.

Rubbing or interference between the auger 470 and the conduit 412, may cause the powder 404 to melt and become altered or damaged. Further, an intense amount of heat applied to the powder 404 may cause the powder 404 to clog within the conduit 412. Alignment of the conduit 412 with respect to the conveyor 470 is therefore important.

The auger 470 may be made of any suitable durable material which is not chemically reactive to the powder 404. For example, the auger 470 may be made of stainless steel.

In an automated fill line, an indexing conveyor 178 (see FIGS. 1–4) advances container 16 into position for filling by the apparatus 400. The container 16 includes the container opening 188 through which the powder 404 passes. To provide for quick and clean filling, the conduit 112 preferably includes the nozzle 34 (see FIG. 5) extending from conduit outlet 420.

Referring again to FIG. 1, the conduit 412 is flexibly connected to the hopper 402 in any suitable manner. For example, the conduit 412 may be flexibly connected to the hopper 402 by means of a flexible coupling 458. The conduit 412 is flexibly connected to the hopper 402 so that the hopper 402 and the conduit 412 may be arranged in a first position with the longitudinal axis 418 of the hopper 402 and the longitudinal axis 414 of the conduit 412 being coincident and arranged in a second different position with the longitudinal axis 418 of the hopper 402 and the longitudinal axis 414 of the conduit 412 being skewed with respect to each other.

The flexible coupling 458 is preferably positioned within the conduit 412. Preferably, the flexible coupling 458 is positioned adjacent the conduit inlet 416 of the conduit 412. The flexible coupling 458 is used to permit the conduit longitudinal axis 414 to pivot about the flexible coupling 458. The conduit 412 pivots about pivot point PP located centrally in the flexible coupling 458. The axis 414 may pivot up to an angle α of, for example, 15°.

The amount of alignment correction that may be accomplished through the use of the flexible coupling 458 depends upon several factors including the flexibility of the flexible coupling 458, length CL of the conduit 412 from the pivot point PP to opening 188 of the container 16 when the conduit 412 is barely inserted into the opening 188 of the container 16. The amount of correction that the apparatus 400 can accommodate also depends upon the diameter AD of the periphery 472 of the auger 470 as well as the diameter CID of the internal periphery 474 of the conduit 412.

Since the auger 470 is fixedly secured by bearings 476 to the frame 406 of the hopper 402, the auger 470 is rigidly secured within the apparatus 400. Therefore, the pivoting conduit 412 can only pivot an amount equal to the clearance between the auger diameter AD and the conduit bore diameter CID. The amount of pivoting that the flexible coupling 458 may impart to the conduit 412 may be described by the formula:

$$\alpha=\tan^{-1}[(CID-AD)/2]/(2*CL)$$

Where:

α=the pivoting amount of the conduit 412,

AD=the diameter of the periphery 472 of the auger 470,

CID=the diameter of internal periphery 474 of the conduit 412, and

CL=the length of the conduit 412 from pivot point (PP) to the opening 188.

The flexible coupling 458 may be made of any suitable material, for example, of a natural rubber or an elastomer. The flexible coupling 458 may be secured to the conduit 412 by any suitable means, such as by upper clamp 455 positioned on upper end 461 of the flexible coupling 458 and by a lower clamp 457 positioned on lower end 463 of the flexible coupling 458. The clamps 455 and 457 may be any suitable commercially available clamps, for example, an airplane clamp or any similar hose clamp, capable of adjustably securing the flexible coupling 458 to the conduit 412.

The conduit 412 may be constructed such that, as shown in FIG. 1, the conduit 412 is matingly fitted within the container opening 188 of the container 16. It should be appreciated, however, that the conduit 412 may be positioned with the conduit outlet 420 spaced above the container 16.

The use of the flexible coupling 458 provides for the pivoting of the flexible coupling 458 at an angle up to, for example, α the flexing of the flexible coupling 458 permits the auger 470 positioned within the conduit 412 to have a runout or to be bent such that the auger 470 travels in a conical path within angle α.

The use of the flexible coupling 458 may alternatively, or in addition, assist in the insertion of the conduit 412 into the opening 188 of the container 16. For example, the conduit 412 may include a chamfer or lead-in angled surface (not shown) positioned at the distal end of the conduit 412 to assist a mispositioned conduit 412 in entering opening 188 of the container 16. If the auger 470 is centered within the conduit 412, the conduit 412 may be pivoted to account for misalignment between the conduit 412 and the opening 188 of the container 16. The conduit 412 may have an outer diameter (COD) which is smaller than opening diameter (DOD) of the aperture 188, but it should be appreciated that the pivoting of the conduit 412 will allow for additional indexing error of the container conveying system as the coupling flexes to permit the conduit 412 to enter the opening 188 of the container 16.

The flexible coupling 458 may have any suitable construction, but typically includes a coupling member 453 made of, for example, a rubber material or an elastomer. The coupling member 453 combines with the upper clamp 455 and the lower clamp 457 to form the flexible coupling 458. The coupling member 453 may include, for example, a central portion 465 which may have an arcuate outer periphery 467 defined by radius R and angle β and may include flanges 469 extending outwardly in the direction of axis 418.

The flanges 469 are used to provide a surface for securing the upper clamp 455 and the lower clamp 457 to the coupling member 453. The flanges 469 may be defined by a flange length FL and a flange thickness (FT). Central portion 465 of the coupling member 453 may have a length L of, for example, 0.5 inches and a thickness T of, for example, 0.4 inches. The central portion 465 of the coupling member 453 preferably extends inwardly and is in alignment with inner periphery 474 of the conduit 412.

Referring again to FIG. 4, a side view of moving containers 16 along an indexing conveyor 178 relative to the conduit 412 is depicted, which is relevant to all of the embodiments. Each of the containers is positioned in a carrying device 22, also known as a puck. Each puck is specially designed and built for each type of toner container, the puck allowing for different container widths and heights. A puck is used so that the same conveying and lifting system can be used with varying toner container types.

When the container is in position under the fill tube a lifting mechanism 230 pushes the puck with the container in it up until the lifting mechanism is fully extended. When the lifting mechanism is fully extended, the container is in the proper filling relationship with the fill tube. It should be appreciated that the container may be placed on a conveyor without a puck, particularly if the filling line is a dedicated line and if the container has a self-supporting shape that would not to permit the container to easily tip.

Referring again to FIG. 2, the container is shown in the proper filling relationship to the fill tube, the container opening 188 receiving the end of the conduit 412. The amount of toner loaded in the container is predetermined based on the size of the container and the toner flow is controlled by a particular number of cycles of the high speed filler. Once the predetermined amount of toner passes through the fill tube for a particular number of cycles of the high speed filler the container is filled and the filling process is stopped so that the container may be moved from under the fill tube.

Figure 5:
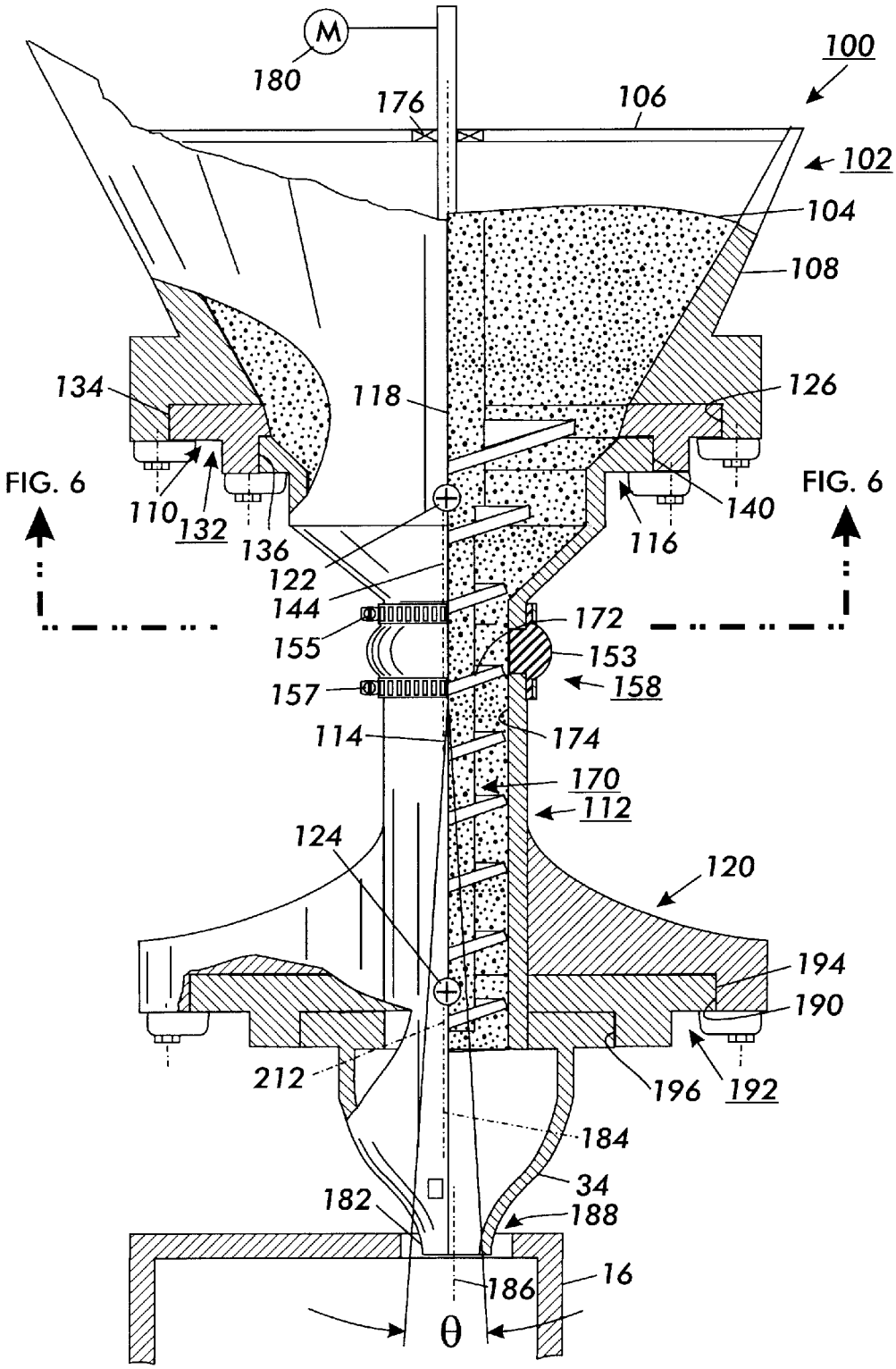
FIG. 5 is a partial cross-sectional schematic view of an alternate embodiment of an auger and flexible conduit arrangement for developer material according to the present invention incorporating alignment adjustment rings for the alignment of the auger to the conduit and for the alignment of the conduit nozzle to the container.

Referring now to FIG. 5, an alternate embodiment to a pivoting nozzle according to the present invention with additional positioning adjustment is shown as apparatus 100. The apparatus 100 is similar to apparatus 400 of FIG. 1 and is mounted to, for example, hopper 102, restoring a supply of powder 104. The hopper 102 includes a hopper frame 106. The hopper frame 106 may be made of any suitable durable material that is not chemically reactive with the powder 104, for example stainless steel, and may either be mounted to other portions of the filling line or separately mounted to the production floor. The hopper 102 may have any suitable shape but preferably includes an inverted conical or funnel shape portion 108 which defines a lower opening 110 therein for permitting the passage of supply of powder 104 therefrom. The hopper 102 defines hopper longitudinal axis 118 thereof.

The hopper 102 may have any suitable size capable of containing a sufficient supply of powder 104. The hopper 102 may be made of any suitable durable material that is not chemically reactive to the powder 104 and may, for example, be made of a stainless steel.

The apparatus 100 includes conduit 112 which is movably connected to the hopper 102. The conduit 112 extends downwardly from the hopper 102. The conduit 112 is adapted to permit a flow of the powder 104 therethrough. The conduit 112 defines conduit longitudinal axis 114 thereof.

The conduit 112 defines a conduit inlet 116 of the conduit 112. The conduit inlet 116 is utilized to receive the supply of powder 104 from the hopper 102. The conduit 112 further defines a conduit outlet 120 for dispelling the powder 104 from the conduit 112. The conduit inlet 116 has an inlet center 122 positioned centrally within the conduit inlet 116. The conduit outlet 120 has a conduit outlet center 124 of the conduit outlet 120 which is positioned centrally within the conduit outlet 120.

The conduit 112 is positioned and mounted with respect to the hopper 102 so that at least one of the inlet center 122 and the outlet center 124 may be movably spaced from the longitudinal axis 118 of the hopper 102 so that as the conduit 112 moves with respect to the hopper 102, the position of the outlet center 124 with respect to the longitudinal axis 118 of the hopper 102 may be altered.

One embodiment of the apparatus 100 in which the outlet center 124 may be positioned with respect to the longitudinal axis 118 of the hopper 102 includes a bore 126 formed in the hopper 102 at the lower opening 110 of the hopper 102. The bore 126 is preferably cylindrical and has a longitudinal axis 118 concentric with longitudinal axis 118 of the hopper 102. The adapter 132 may include an outer periphery 134 which mates with bore 126 formed in the hopper 102. The outer periphery of the conduit 112 may be eccentric with the longitudinal axis 114 of the conduit 112 such that as the conduit 112 is rotated, the longitudinal axis 114 of the conduit 112 moves with respect to the longitudinal axis 118 of the hopper 102. The longitudinal axis 114 of the conduit 112 is thus offset at a certain distance from the longitudinal axis 118 of the hopper 102 therefore providing for a outlet center 124 which is spaced from the longitudinal axis 118 of the hopper 102.

The configuration with the conduit 112 eccentrically positioned within adapter 132 provides for an offset, but does not provide for a complete two-directional positioning of the longitudinal axis 114 of the conduit 112 with respect to the longitudinal axis 118 of the hopper 102. To accomplish this more complete adjustment, an adapter 132 is positioned between the hopper 102 and the conduit 112. The adapter 132 includes an outer periphery 134 which is rotatably fitted to bore 126 of the hopper 102.

The adapter 132 may be made of any suitable durable material which is not chemically reactive with the powder 104. For example, the adapter 132 may be made of a metal or a plastic. Preferably the adapter 132 is made of stainless steel.

The adapter 132 further includes a adapter bore 136. The bore 136 is preferably cylindrical in shape and is matingly fitted to conduit inlet cylindrical outer periphery 140. The adapter bore 136 is eccentric with the adapter outer periphery 134.

Figure 6:
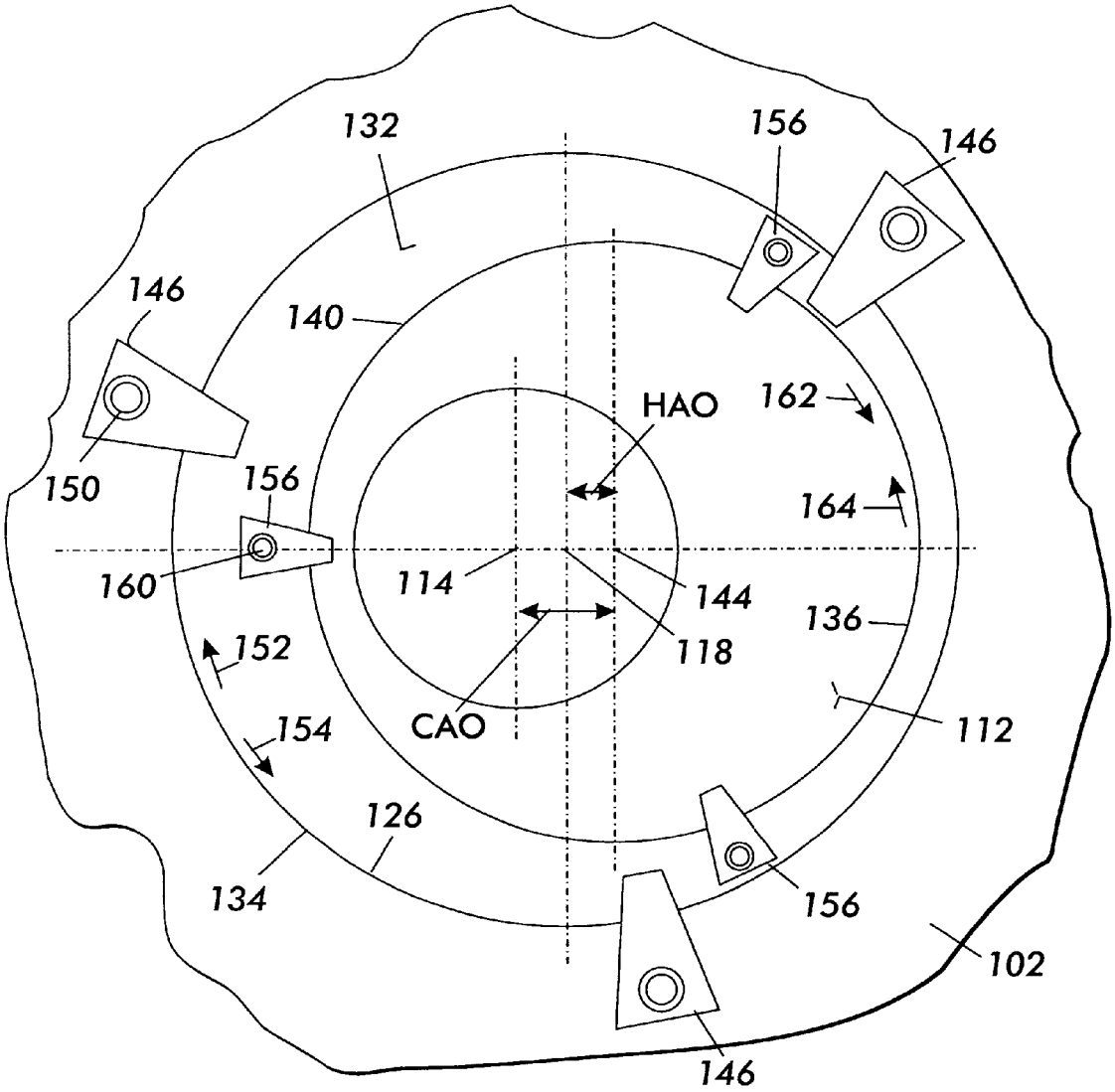
FIG. 6 is a view along the line 6—6 in further details of the FIG. 5 filling unit.

Referring now to FIG. 6, the adapter 132 is shown is greater detail. The adapter 132 is positioned between hopper 102 and conduit 112. The adapter outer periphery 134 has a longitudinal axis coincident with the hopper longitudinal axis 118 while the adapter bore 136 has a longitudinal axis 144 offset from the longitudinal axis of the adapter outer periphery 134 or the hopper longitudinal axis 118, a distance of HAO of, for example, 0.25 inches. The conduit inlet outer periphery 140 has a conduit inlet outer periphery longitudinal axis coincident with the adapter bore longitudinal axis 144 which is offset from conduit longitudinal axis 114 of the conduit 112, a distance of, for example, CAO of, for example, 0.50 inches.

The adapter 132 is rotatably secured to the hopper 102 by any suitable means. For example, a series of, for example, 3 hopper clamps 146 are equally spaced about the hopper 102 and are preferably threadably secured by fasteners 150 to the hopper 102. When the fasteners 150 are loosened, the adapter 132 is permitted to rotate clockwise in the direction of arrow 152 as well as counterclockwise in the direction of arrow 154.

The conduit 112 is rotatably secured to the adapter 132 by any suitable means. For example, a quantity of, for example, 3 equally spaced conduit clamps 156 are threadably secured to the adapter 132 by fasteners 160. When the fasteners 160 are loosened, the conduit 112 is permitted to rotate with respect to the adaptor 132 clockwise in the direction of arrow 162 and counterclockwise in the direction of arrow 164 such that the conduit longitudinal axis 114 of the conduit 112 may be moved with respect to the hopper longitudinal axis 118.

By simultaneously rotating the adapter 132 in either the direction of arrows 152 or 154 and rotating the conduit 112 in the direction arrows 162 or 164, the position of the conduit longitudinal axis 114 may be adjusted with respect to the longitudinal axis 118 of the hopper 102 so that the auger 170 may freely rotate within the conduit 112. Friction and heat generated between the auger and the conduit 112 may thus be minimized.

Referring again to FIG. 5, the conduit 112 may be made of any suitable durable material that is not chemically reactive with the powder 104. For example, the conduit 112 may be made of a metal or a plastic. Preferably the conduit 112 is made of stainless steel.

Preferably, to assist in the flow of powder 104 through the conduit 112, the apparatus 100 further includes conveyor 170 in the form of a helical auger. The auger 170 includes a cylindrical outer periphery 172 which is matingly fitted to an inner periphery 174 of the conduit 112.

Preferably, the auger 170 is rotatably secured to hopper frame 106 by bearings 176. The auger 170 may be propelled by any suitable means, for example, by motor 180 connected to the auger 170. The outer periphery 172 of the auger 170 is concentric with the longitudinal axis 118 of the hopper 102 and the auger 170 is mounted onto bearings 176 such that the conveyor 170 rotates about the longitudinal axis 118 of the hopper 102 as well.

Since the auger 170 rotates about the conduit 112, it is important that the auger 170 is in proper alignment with the conduit 112 such that the outer periphery 172 of the auger 170 does not rub or bind against inner periphery 174 of the conduit 112.

Rubbing or interference between the auger 170 and the conduit 112, may cause the powder 104 to melt and become altered or damaged. Further, an intense amount of heat applied to the powder 104 may cause the powder 104 to clog within the conduit 112.

Alignment of the conduit 112 with respect to the auger 170 is therefore important. The adapter 132 is used to position the conduit 112 such that the longitudinal axis 114 of the conduit 112 is coincident with longitudinal axis 118 of the hopper 102 and of the auger 170.

The auger 170 may be made of any suitable durable material which is not chemically reactive to the powder 104. For example, the auger 170 may be made of stainless steel.

The apparatus 100 is similar to apparatus 400 and includes a flexible coupling 158 which is similar to flexible coupling 458 of the apparatus 400 of FIG. 1. The flexible coupling 158 includes a flexible member 153 which is secured to the conduit 112 by upper clamp 155 and lower clamp 157. The clamps 155 and 157 are similar to clamps 455 and 457 of the apparatus 400 of FIG. 1.

The flexible coupling 158 is positioned within the conduit 112 and is used to permit the conduit longitudinal axis 114 to pivot about the flexible coupling 158. The conduit longitudinal axis 114 may pivot up to an angle θ of, for example, 15°.

The flexible coupling 158 may be made of any suitable material such as, for example, of a natural rubber or an elastomer. The flexible coupling 158 may have any suitable shape but, preferably, has a shape and is made of a material similar to flexible coupling 458 of the apparatus 400 of FIG. 1.

The use of the flexible coupling 158 provides for the pivoting of the conduit 112 at an angle θ. The flexing of the flexible coupling 158 permits the auger 170 positioned within the conduit 112 to have a runout or to be bent such that the auger 170 travels in a conical path within angle θ (or angle θ/2 from the longitudinal axis 114 of conduit 112).

Referring again to FIG. 5, the nozzle 34 includes a nozzle outer periphery 182 which matingly fits with the container opening 188. To assure that the outer periphery 182 of the nozzle 34 fits within the container opening 188, particularly due to the positioning of successive containers 16 under the apparatus 100, preferably, the nozzle 34 is adjustably positioned with respect to the conduit outlet 120. This positioning need necessitates an adjustment to assure that longitudinal axis 184 of the nozzle 34 is concentric with, or in alignment with, longitudinal axis 186 of the container opening 188.

Preferably, the conduit outlet 120 includes a cylindrical outlet bore 190 to which the nozzle 34 is rotatably and eccentrically located with respect to longitudinal axis 184 of the nozzle 34 such that as the nozzle 34 is rotated, the position of longitudinal axis 184 of the nozzle 34 may be adjusted. The longitudinal axis 184 the nozzle 34 may thus be aligned with longitudinal axis 186 of the container opening 188.

Preferably, however, to provide for additional adjustment between the longitudinal axis 184 of the nozzle 34 and the longitudinal axis 186 of the container opening 188, a nozzle adapter 192 is positioned between the conduit outlet 120 and the nozzle 34. The nozzle adapter 192 includes a cylindrical outer periphery 194 and a cylindrical bore 196.

Figure 7:
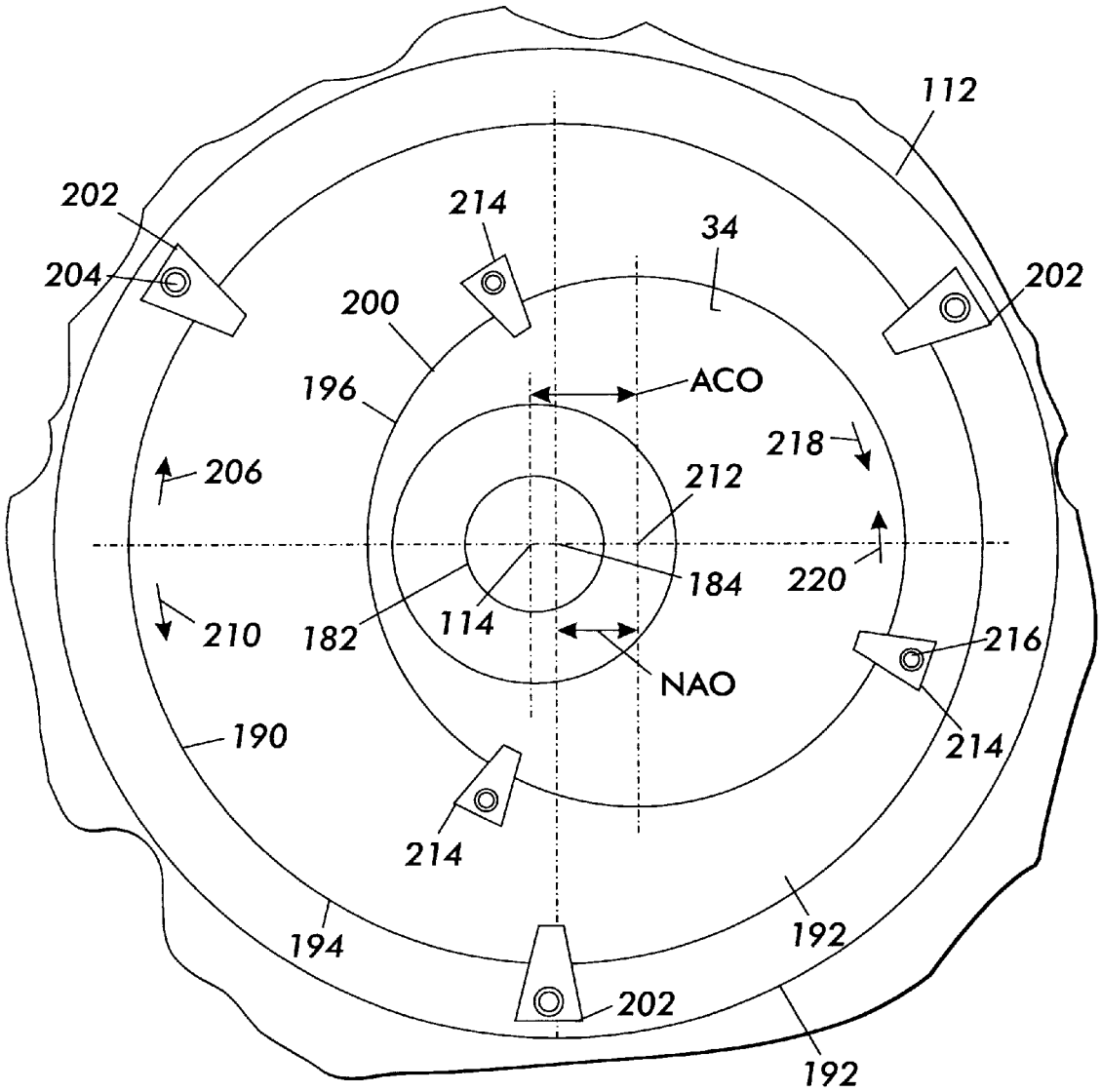
FIG. 7 is a bottom view of the hopper, adaptor and fill tube of the FIG. 5 filling unit.

Referring now to FIG. 7, the nozzle adapter 192 is shown in greater detail. Adapter bore 196 of the adapter 192 is matingly fitted with nozzle outer periphery 200 of nozzle 34.

The nozzle adapter 192 may be made of any suitable durable material which is chemically nonreactive with the powder 104. For example, the adapter 192 may be made of a plastic or a metal. The adaptor 192 may be made of stainless steel.

The nozzle adapter 192 is rotatably secured to the conduit 112 by any suitable means. For example, a set of conduit clamps 202 may be positioned about the adapter 192 and may be secured to the conduit 112 by means of fasteners 204 which are threadably secured to the conduit 112.

When the fasteners 204 are loosened, the adapter 192 may be rotated either clockwise in the direction of arrow 206 or counterclockwise in the direction of arrow 210. By rotating the adapter 192, adapter bore longitudinal axis 212 may be permitted to move relative to conduit longitudinal axis 114. The adapter bore longitudinal axis 212 may be positioned a distance ACO from the conduit longitudinal axis 114 at any suitable distance, for example, 0.5 inches.

The nozzle 34 may be rotatably secured to the adapter 192 in any suitable fashion. For example, the nozzle 34 may be secured to the adapter 192 by nozzle clamps 214 positioned equally about the nozzle 34 and secured to the adapter 192 by means of fasteners 216 which are threadably secured to the adapter 192. When the fasteners 216 are loosened, the nozzle 34 may be permitted to rotate clockwise in the direction of arrow 218 and counterclockwise in the direction of arrow 220 to permit the nozzle longitudinal axis 184 to be moved with respect to the adapter bore longitudinal axis 212. The nozzle longitudinal axis 184 may be positioned a distance NAO from the adapter bore longitudinal axis 212 of, for example, 0.25 inches.

By simultaneously loosening the fasteners 204 on the conduit 112 and the fasteners 216 on the adapter 192, the position of the nozzle longitudinal axis 184 may be altered such that the nozzle longitudinal axis 184 may be made to the coincident with the longitudinal axis 186 of the conduit opening 188 (see FIG. 5).

The nozzle 34 may be made of any suitable durable material that is not chemically reactive with the powder 104. For example, the nozzle 34 may be made of a plastic or a metal. The nozzle 34 may be made of stainless steel.

Figure 8:
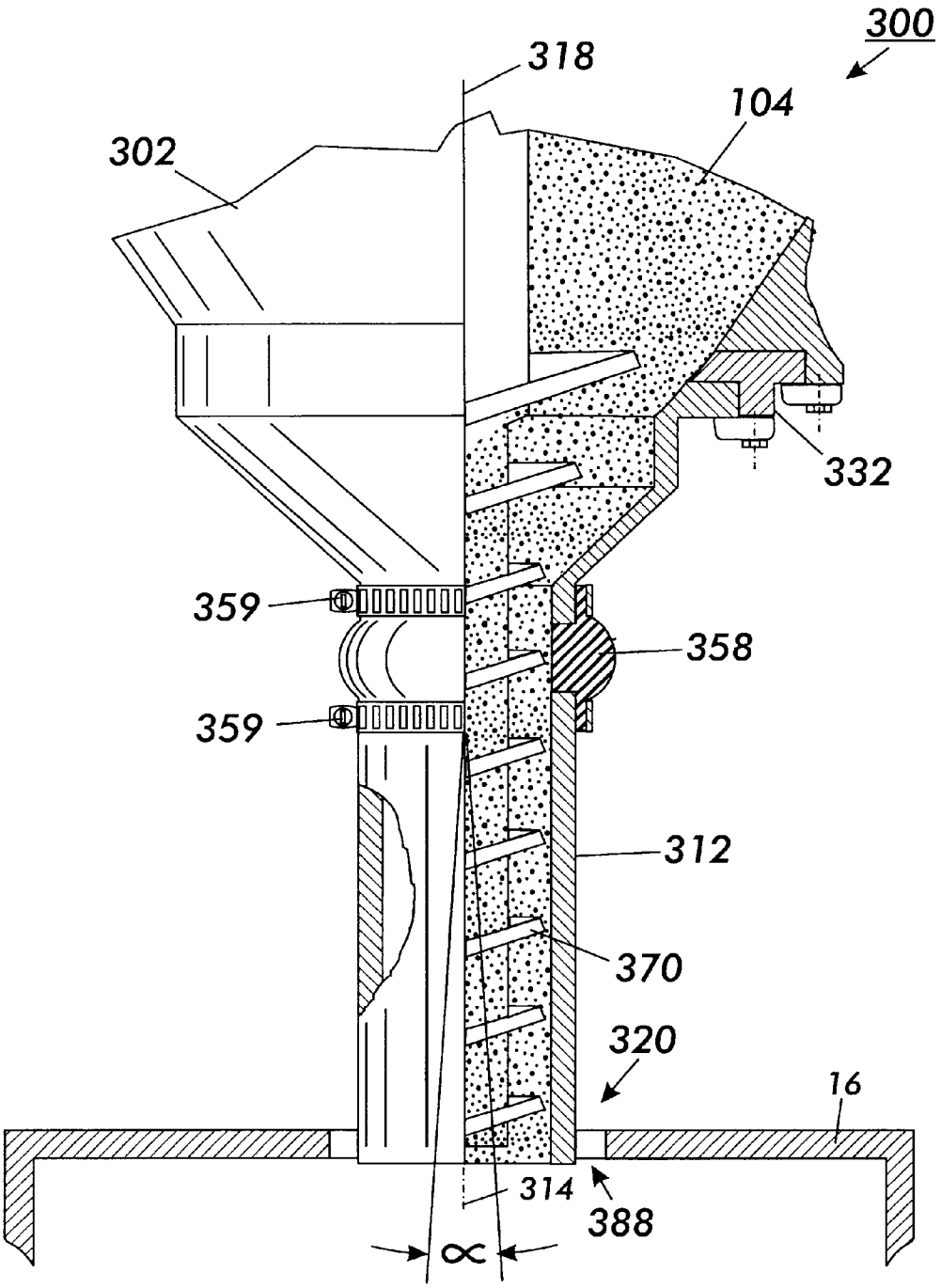
FIG. 8 is a partial cross-sectional schematic view of a second alternate embodiment of a eccentric filling unit for developer material according to the present invention incorporating an alignment adjustment ring for the alignment of the auger to the conduit.

Referring now to FIG. 8, another alternate embodiment of the pivoting nozzle for toner filling including only an alignment adaptor between the hopper and the conduit is shown as apparatus 300. Apparatus 300 is similar to apparatus 400 of FIG. 1, except that apparatus 300 further includes a flexible coupling 358 positioned in the conduit 312. The conduit 312 is similar to conduit 412 of FIG. 1, except for the flexible coupling 358.

The apparatus 300 includes hopper 302 for holding a supply of the powder 104. The hopper 302 is similar to the hopper 402 of apparatus 400. A hopper adapter 332 similar to hopper adapter 432 of FIG. 1, is rotatably connected to hopper 302. The hopper adapter 332 is similar to hopper adapter 432 of FIG. 1, and is used to position the conduit 312 with respect to the hopper 302 such that conduit longitudinal axis 314 may be concentric with auger longitudinal axis 318.

The conduit 312 is similar to conduit 412 of FIG. 1 except that conduit 312 further includes flexible coupling 358 positioned within the conduit 318 which is used to permit the conduit longitudinal axis 314 to pivot about the flexible coupling 358. The axis 314 may pivot up to an angle α of, for example, 15 degrees.

The flexible coupling 358 may be made of any suitable material, such as, for example, of a natural rubber or an elastomer. The flexible coupling 358 may be secured to the conduit by any suitable means, such as by a pair of external clamps 359 positioned on the upper and lower ends of the flexible coupling 358. The clamps 359 may be any suitable commercially available clamps capable of adjustably securing the flexible coupling 358 to the conduit 312.

The conduit 312 may be constructed such that, as shown in FIG. 8, the conduit 312 is matingly fitted within container opening 388 of container 16. It should be appreciated, however, that the conduit 312 may be positioned with the conduit outlet 320 above the container 16.

The conduit outlet 320 may include a nozzle (not shown) similar to nozzle 34 of FIG. 1 positioned variably by a nozzle adapter (not shown) similar to nozzle adapter 192 of FIG. 5. It should be appreciated that because of the added alignment adjustment afforded because of the flexible coupling 358, a nozzle adapter and a nozzle may not be required for apparatus 300.

The use of the flexible coupling 358 provides for the pivoting of the flexible coupling 358 at angle α. The flexing of the flexible coupling 358 permits auger 370 positioned within the conduit 312 to have runout or be bent such that the auger 370 travels in a conical path within angle α.

By providing a flexible coupling positioned between the auger and the conduit, the alignment of the auger and conduit may be improved.

By providing a flexible coupling between the auger and the conduit, the alignment of the auger and conduit may be optimized to prevent the rubbing between the auger and the conduit and resultant heat and powder damage caused thereby.

By providing a flexible coupling between the auger and the conduit, the center lines of the auger and conduit may be made coincident to eliminate the heat caused by rubbing between the auger and the conduit.

By providing a flexible coupling between the conduit and the nozzle, alignment of the nozzle and the container may be improved. Spilling of powder may be reduced and the filling speed possible for the filling system may be increased.

By providing a flexible coupling located between the conduit and the nozzle, the alignment of the nozzle to the container may be improved in a container filling system such that the spilling of toner may be reduced and such that the index speed of the container conveyor may be increased.

By providing an eccentric ring positioned between the auger and the conduit, the alignment of the auger and conduit may be improved.

By providing eccentric rings between the auger and the conduit, the alignment of the auger and conduit may be optimized to prevent the rubbing between the auger and the conduit and resultant heat and powder damage caused thereby.

By providing a pair of eccentric rings between the auger and the conduit, the center lines of the auger and conduit may be made coincident to eliminate the heat caused by rubbing between the auger and the conduit.

By providing eccentric rings between the conduit and the nozzle, alignment of the nozzle and the container may be improved. Spilling of powder may be reduced and the filling speed possible for the filling system may be increased.

By providing a pair of eccentric rings located between the conduit and the nozzle, the alignment of the nozzle to the container may be improved in a container filling system such that the spilling of toner may be reduced and such that the index speed of the container conveyor may be increased.

In recapitulation, a high speed toner filler for developer material has been described as an improved method for aligning a conduit to an auger and a nozzle to a container. This method allows a powder filling system to be aligned more accurately and rapidly than prior art systems and also insures that the toner container is filled quickly, completely and cleanly.

It is, therefore, apparent that there has been provided in accordance with the present invention, a pivoting high speed toner filler nozzle that fully satisfies the aims and advantages hereinbefore set forth. While this invention has been described in conjunction with specific embodiments, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for assisting in filling a container from a hopper containing a supply of powder, the apparatus comprising a hopper and a conduit flexibly connected to the hopper and extending downwardly therefrom, said conduit adapted to permit a flow of powder therewithin, said conduit defining a longitudinal axis thereof, the hopper defining a longitudinal axis thereof, said conduit flexibly connected to the hopper so that the hopper and said conduit may be arranged in a first position with the longitudinal axis of the hopper and the longitudinal axis of said conduit being coincident and arranged in a second position with the longitudinal axis of the hopper and the longitudinal axis of said conduit being skewed with respect to each other; and a conveyor located at least partially within said conduit, the conveyor assisting to provide the flow of powder from the container.

2. An apparatus for assisting in filling a container from a hopper containing a supply of powder, as claimed in claim 1, wherein a portion of said conduit comprises a flexible material.

3. An apparatus for assisting in filling a container from a hopper containing a supply of powder, as claimed in claim 1, further comprising a flexible member positioned between said conduit and the hopper.

4. An apparatus for assisting in filling a container from a hopper containing a supply of powder, as claimed in claim 1, wherein at least a portion of said flexible member comprises a rubber or an elastomer.

5. An apparatus for assisting in filling a container from a hopper containing a supply of powder, as claimed in claim 1, further comprising an adaptor positioned between the hopper and said conduit, said adaptor defining a longitudinal axis thereof, said adaptor defining an adaptor inlet thereof for receiving the supply of powder from the hopper and an adaptor outlet for dispelling the powder therefrom, the adaptor inlet having an adaptor inlet center thereof and the adaptor outlet having an adaptor outlet center thereof, at least one of the adaptor inlet center and the adaptor outlet center being spaced from the adaptor longitudinal axis of said adaptor, so that as the adaptor is rotated with respect to the hopper, the position of the adaptor outlet center, with respect to the hopper, changes.

6. An apparatus for assisting in filling a container from a hopper containing a supply of powder, as claimed in claim 1 further comprising:

a conveyor located at least partially within said conduit, the conveyor assisting to provide the flow of powder from the container; and a nozzle operably connected to said conduit and extending downwardly therefrom.

7. An apparatus for assisting in filling a container from a hopper containing a supply of powder, as claimed in claim 6, wherein said nozzle defines a nozzle longitudinal axis thereof, said nozzle defining an nozzle inlet thereof for receiving the supply of powder from said conduit and an nozzle outlet for dispelling the powder from said nozzle, the nozzle inlet having an nozzle inlet center thereof and the nozzle outlet having an nozzle outlet center thereof, at least one of the nozzle inlet center and the nozzle outlet center being spaced from the longitudinal axis of said nozzle, so that as said nozzle is rotated with respect to said conduit, the position of the nozzle outlet center with respect to said conduit changes.

8. An apparatus for assisting in filling a container from a hopper containing a supply of powder, as claimed in claim 7, further comprising an adaptor positioned between said conduit and said nozzle, said adaptor defining a longitudinal axis thereof, said adaptor defining an adaptor inlet thereof for receiving the supply of powder from said conduit and an adaptor outlet for dispelling the powder into said nozzle, the adaptor inlet having an adaptor inlet center thereof and the adaptor outlet having an adaptor outlet center thereof, at least one of the adaptor inlet center and the adaptor outlet center being spaced from the adaptor longitudinal axis of said adaptor, so that, as the adaptor is rotated with respect to said conduit, the position of the adaptor outlet center with respect to said conduit changes.

9. An apparatus for assisting in filling a container from a hopper containing a supply of powder, as claimed in claim 1, wherein said conduit is flexibly connected to the hopper so that the hopper and said conduit may be arranged in a first position with the longitudinal axis of the hopper and the longitudinal axis of said conduit being coincident and arranged in a second position with the longitudinal axis of the hopper and the longitudinal axis of said conduit being skewed with respect to each other, the longitudinal axis of the hopper and the longitudinal axis of said conduit forming an angle therebetween of from 0 to 30 degrees.

10. An apparatus for assisting in filling a container from a hopper containing a supply of powder, as claimed in claim 9, wherein the longitudinal axis of the hopper and the longitudinal axis of said conduit are permitted to form an angle therebetween of from 10 to 20 degrees.

11. An apparatus for assisting in filling a container from a hopper containing a supply of powder, as claimed in claim 1, wherein the longitudinal axis of the hopper and the longitudinal axis of said conduit are permitted to form an angle therebetween of from 0 to 40 degrees with the longitudinal axis of the hopper and the longitudinal axis of said conduit being permitted to be positioned 0 to 40 degrees from a vertical direction.

12. A method for filling a powder container with a supply of powder in a hopper, the method comprising the steps of:

positioning a conduit in a powder receiving relationship below the supply of powder in a hopper;

inserting an auger at least partially within the conduit for assisting in the flow of the supply of powder through the conduit; and repositioning the conduit with respect to the auger by pivoting at least one of the conduit and the hopper with respect to each other.

13. A method for filling a powder container with a supply of powder in a hopper as in claim 12, wherein the repositioning step comprises:

installing a flexible member between the hopper and the conduit; and permitting the flexible member to flex so that the conduit and the hopper may pivot with respect to each other.

14. A method for filling a powder container with a supply of powder in a hopper as in claim 12:

further comprising the step of positioning a hopper adaptor in a powder receiving relationship below the supply of powder in a hopper and above the conduit after the conduit positioning step; and further comprising a conduit aligning step of repositioning at least one of the conduit and the adaptor with respect to the auger by moving at least one of the conduit, the adaptor and the hopper with respect to at least one of the other of the conduit, the adaptor and the hopper.

15. A method for filling a powder container with a supply of powder in a hopper as in claim 12:

further comprising the step of positioning a nozzle in a powder receiving relationship below the conduit after the conduit positioning step;

further comprising the step of positioning a nozzle adaptor in a powder receiving relationship below the conduit and above the nozzle after the conduit positioning step; and further comprising a nozzle aligning step of repositioning at least one of the conduit and the adaptor with respect to the nozzle by moving at least one of the conduit, the adaptor and the nozzle with respect to at least one of the other of the conduit, the adaptor and the nozzle.

16. A method for filling a powder container with a supply of powder in a hopper, the method comprising the steps of:

positioning a conduit with a nozzle feature in a powder receiving relationship below the supply of powder in a hopper;

placing a first powder container to be filled in filling relationship to the conduit;

repositioning the conduit with respect to the first powder container by pivoting at least one of the conduit and the hopper with respect to each other;

dispensing powder through the conduit, through the nozzle feature and into the first container;

removing the first container from filling relationship to the hopper; and placing a second container to be filled in filling relationship to the hopper.

17. A method for filling a powder container with a supply of powder in a hopper as in claim 16, wherein the repositioning step comprises:

installing a flexible member between the hopper and the conduit; and permitting the flexible member to flex so that the conduit and the hopper may pivot with respect to each other.

18. A method for filling a powder container with a supply of powder in a hopper as in claim 16:

further comprising the step of positioning an adaptor in a powder receiving relationship between the conduit and the hopper; and wherein the repositioning step comprises repositioning at least one of the conduit and the adaptor with respect to the hopper by rotating at least one of the conduit, and the adaptor with respect to at least one of the other of the conduit, and the adaptor.

19. A method for filling a powder container with a supply of powder in a hopper as in claim 16:

further comprising the step of positioning a hopper adaptor in a powder receiving relationship below the supply of powder in a hopper and above the conduit after the conduit positioning step; and further comprising a conduit aligning step of repositioning at least one of the conduit and the adaptor with respect to the auger by moving at least one of the conduit, the adaptor and the hopper with respect to at least one of the other of the conduit, the adaptor and the hopper.

* * * * *